US010169993B1

(12) United States Patent
Dance et al.

(10) Patent No.: US 10,169,993 B1
(45) Date of Patent: Jan. 1, 2019

(54) FORECASTING WITH MATRIX POWERS

(71) Applicant: Conduent Business Services, LLC, Dallas, TX (US)

(72) Inventors: Christopher R. Dance, Grenoble (FR); Tomi Silander, Grenoble (FR)

(73) Assignee: Conduent Business Services, LLC, Dallas, TX (US)

( * ) Notice: Subject to any disclaimer, the term of this patent is extended or adjusted under 35 U.S.C. 154(b) by 0 days.

(21) Appl. No.: 15/868,007

(22) Filed: Jan. 11, 2018

(51) Int. Cl.
*G08G 1/14* (2006.01)

(52) U.S. Cl.
CPC ..... *G08G 1/14* (2013.01); *G08G 1/141* (2013.01); *G08G 1/143* (2013.01)

(58) Field of Classification Search
CPC ..... G08G 1/01; G08G 1/0137; G08G 1/14; G08G 1/141; G08G 1/144; G08G 1/147; G08G 1/148; G07B 15/02; G01C 21/3679; G01C 21/3685
See application file for complete search history.

(56) References Cited

U.S. PATENT DOCUMENTS 10,032,368 B1 * 7/2018 Thompson ..... G08G 1/0137
2012/0161984 A1 * 6/2012 Amir ..... G01C 21/3685 340/932.2
2014/0340242 A1 * 11/2014 Belzner ..... G08G 1/14 340/932.2
2015/0161891 A1 * 6/2015 Dance ..... G06Q 10/063 705/7.11
2017/0191849 A1 * 7/2017 Agam ..... G01C 21/3685

OTHER PUBLICATIONS

Neuts, "A versatile Markovian point process," Journal of Applied Probability, vol. 16 (4), pp. 764-779 (1979).
Al-Mohy, et al., "Computing the Freéchet derivative of the matrix exponential, with an application to condition number estimation," SIAM Journal on Matrix Analysis and Applications, vol. 30 (4), pp. 1639-1657 (2009).
Al-Mohy, et al.,"Computing the Fréchet derivative of the matrix logarithm and estimating the condition number," SIAM Journal on Scientific Computing, vol. 35 (4), pp. C394-C410 (2013).
(Continued)

*Primary Examiner* — Van T Trieu
(74) *Attorney, Agent, or Firm* — Fay Sharpe LLP

(57) ABSTRACT

Data characterizing a system is received at an electronic processor. For example, parking event data from parking sensors of a parking facility is received. The electronic processor constructs a current state for the system (e.g. parking occupancy state of the parking facility) at a current time from the received data. State probabilities at a future time are computed (e.g. occupancy state probabilities are computed for the parking facility) using a continuous-time Markov chain model modified by multiplying the time input to the model by a random variable and scaling the state probabilities by an expectation of the random variable. In parking occupancy forecasting, parking guidance information is generated based at least on the computed occupancy state probabilities, and is transmitted to an electronic device other than the electronic processor (e.g. a parking recommendation transmitted to a vehicle navigation device, or a control signal transmitted to a "lot full" sign).

20 Claims, 4 Drawing Sheets

(56) References Cited

OTHER PUBLICATIONS

Al-Mohy, Awad H. et al., "Computing the Fréchet Derivative of the Matrix Exponential, with an Application to Condition Number Estimation", SIAM Journal on Matrix Analysis and Applications, vol. 30. No. 4, pp. 1639-1657, 2009.
Al-Mony, Awad H. et al., "Computing the Fréchet Derivative of the Matrix Logarithm and Estimating the Condition Number", SIAM Journal on Scientific Computing, vol. 35, No. 4, pp. C394-C410, 2013.
Neuts, Marcel, "A Versatile Markovian Point Process", Journal of Applied Probability, vol. 16, No. 4, pp. 764-779, Dec. 1979.

* cited by examiner

FORECASTING WITH MATRIX POWERS

BACKGROUND

The following relates to the parking occupancy forecasting and guidance arts, and more generally to system state forecasting over short time horizons e.g. on the order of 1-20 minutes in some tasks, and to related arts.

In a common task, parking occupancy forecasting is desirably performed on a short time horizon of, for example, 2-10 minutes. As other illustrative tasks, it may be desired to forecast the number of jobs at a particular stage of a process in a print shop, or the number of people waiting in an emergency medical facility on a time scale over which it is possible to redeploy resources. Frequently, continuous time (semi-)Markov models are applied for such purposes. In these approaches, predictions are given by computing matrix exponentials. However, real-world systems are often more variable than such models predict. For instance, in parking occupancy forecasting, there may be variation in parking demand from day-to-day, and/or parking sensor observations may be subject to variable delays.

BRIEF DESCRIPTION

In some embodiments disclosed herein, a parking guidance device comprises an electronic processor and a non-transitory storage medium operatively connected with the electronic processor and storing instructions readable and executable by the electronic processor to perform a parking guidance method. The parking guidance method suitably includes: receiving, at the electronic processor, parking event data acquired by parking sensors of a parking facility; constructing a current occupancy state i for the parking facility at a time t from the received parking event data wherein the current occupancy state estimates a fraction of parking spaces of the parking facility occupied at the time t; computing occupancy state probabilities for the parking facility at a future time t+s using the matrix quantity $\mathbb{E}(\xi)\cdot\mathrm{expm}(Q\xi s)$ where expm( . . . ) denotes the matrix exponential, Q is a generator matrix, and $\xi$ is a random variable; generating parking guidance information based at least on the computed occupancy state probabilities; and transmitting the parking guidance information to an electronic device other than the electronic processor.

In some embodiments disclosed herein, a non-transitory storage medium stores instructions readable and executable by an electronic processor to perform a forecasting method comprising: receiving, at the electronic processor, data characterizing a system; constructing a current state i of the system at a time t from the received data; constructing a current state i of the system at a time t from the received data; computing probabilities $p_{ij}$ of the state of the system at a future time t+s where $p_{ij}$ is the probability that the system is in state j at the future time t+s and $p_{ij}$ is computed to have a value given by $p_{ij}=\mathbb{E}(\xi)\,[\mathrm{expm}(Q\xi s)]_{ij}$ where expm( . . . ) denotes the matrix exponential, Q is a generator matrix, $\xi$ is a random variable having a non-negative probability density function, and $[\mathrm{expm}(Q\xi s)]_{ij}$ denotes element (i,j) of the matrix quantity $\mathbb{E}(\xi)\cdot\mathrm{expm}(Q\xi s)$; and generating a forecast state of the system at the future time t+s based on the computed probabilities pi.

In some embodiments disclosed herein, a parking guidance method is disclosed. Parking event data acquired by parking sensors of a parking facility is received at an electronic processor. The electronic processor reads and executes instructions stored on a non-transitory storage medium to perform operations including: constructing a current occupancy state i for the parking facility at a time t from the received parking event data wherein the current occupancy state estimates the fraction of occupied parking spaces of the parking facility at the time t; computing occupancy state probabilities for the parking facility at a future time t+s using a continuous-time Markov chain model modified by multiplying the time s input to the model by a random variable $\xi$ and scaling the occupancy state probabilities by an expectation of the random variable $\xi$; and generating parking guidance information based at least on the computed occupancy state probabilities. The parking guidance information is transmitted to an electronic device other than the electronic processor.

DETAILED DESCRIPTION

In some embodiments disclosed herein, forecasting is performed using a likelihood function based on matrix powers to forecast a process that is more variable than suggested by a Markov model. This provides a simple and natural formula which captures extra variability.

Illustrative embodiments described herein are directed to parking occupancy forecasting for a parking facility, such as an open parking lot, an enclosed parking garage, a streetside parking block, or so forth, and to higher level tasks leveraging such occupancy forecasting such as providing parking facility recommendations to a vehicle navigator device, operating a "Lot full" sign of a parking facility, or so forth. These are merely illustrative tasks, and it will be appreciated that the system state forecasting techniques disclosed herein may be applied to diverse applications, e.g. other tasks benefiting from accurate parking occupancy forecasts, or tasks employing forecasting of the future state of some other type of system, such as the number of queued print jobs at a print shop, or forecasting the waiting list for an Emergency Medical Department, or so forth.

Figure 1:
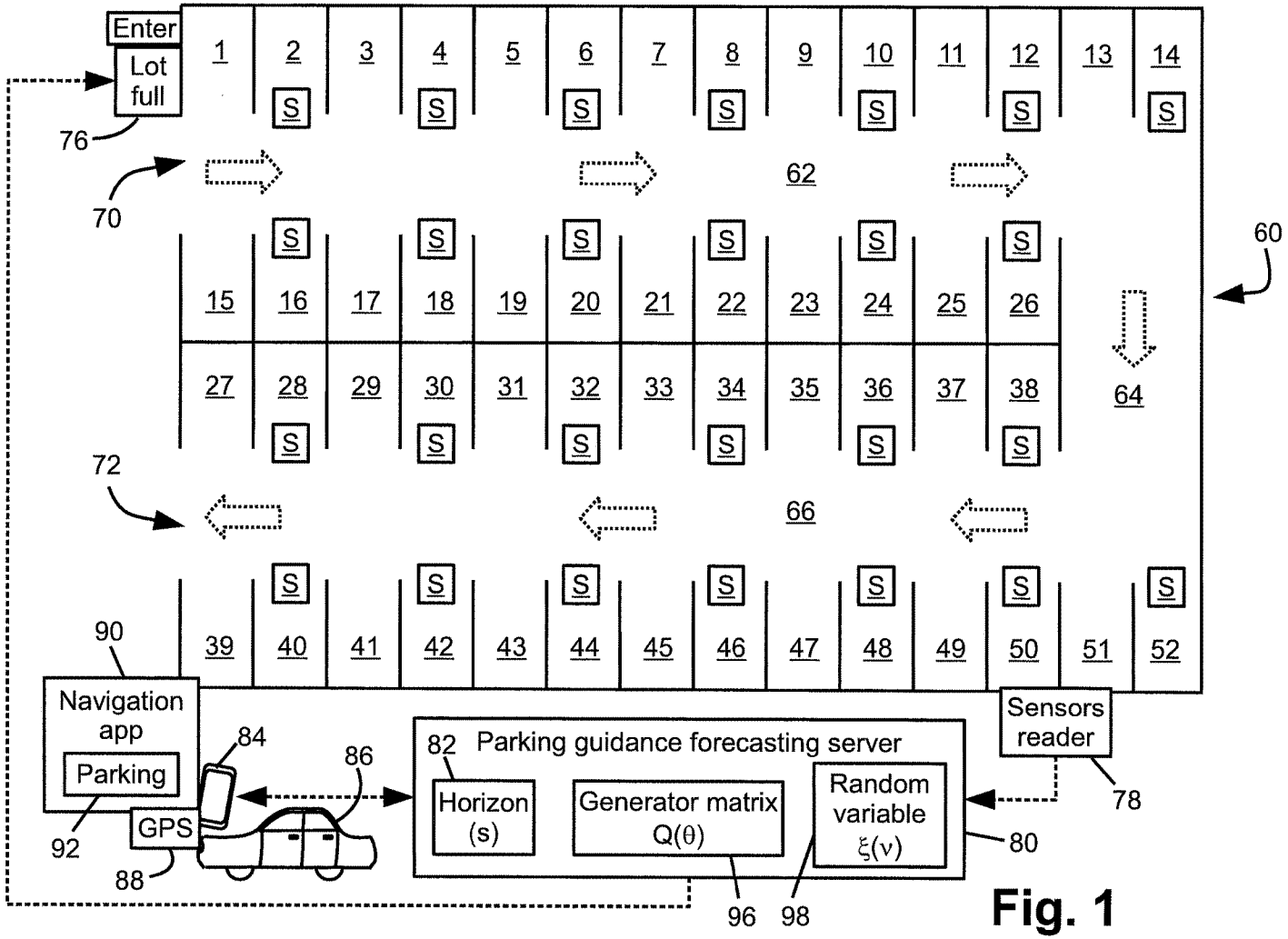
FIG. 1 diagrammatically illustrates a parking guidance system.

With reference to FIG. 1, the illustrative parking occupancy task endeavors to forecast parking occupancy of a number of parking spaces, namely 52 parking spaces in illustrative FIG. 1 designated by respective reference numbers 1-52, of a parking facility 60. The illustrative parking facility 60 is a parking lot or parking garage that further includes drive lanes 62, 64, 66 and an entrance 70 and an exit 72 by which a vehicle accesses a parking space. A "Lot Full" sign 76 is dispose proximate to the entrance 70 to inform the driver of a vehicle contemplating parking at the parking facility 60 as to whether a parking space is likely to be available.

To provide parking event data for use in parking occupancy forecasting, at least a portion of the parking spaces are monitored by parking sensors S. In the illustrative example, only even-spaced parking spaces are monitored by respective parking sensors S—this approach reduces the cost of installing and maintaining the parking sensors S. In the illustrative example with even-numbered parking spaces monitored by the parking sensors S it follows that one-half of the parking spaces are monitored; in other embodiments, a greater or lesser fraction of parking spaces may be monitored. In general, monitoring one-half or fewer fo the parking spaces is likely to provide substantial sensor cost savings. The parking sensors S may monitor actual occupancy of a parking space, e.g. outputting "1" if the space is occupied or "0" if unoccupied. An example of such a parking sensor is a weight-based parking sensor that is activated by the weight of a vehicle occupying the parking space. Alternatively, the parking sensors S may monitor parking arrival and departure events, for example using motion detection sensors. It will be appreciated that in considering these two examples, the weight-based occupancy sensors are likely to be more accurate but much costly to install and difficult to retrofit to an existing parking facility (since doing so entails installing the weight sensors underneath the concrete or other lot surface). By contrast, motion detection sensors are likely to be less expensive to install and are amenable to retrofit installation; however, they are more likely to produce erroneous sensor data, e.g. due to detection of spurious motion due to passing vehicles or persons.

In a typical setup, a sensors reader 78 is operatively connected to receive parking event data (e.g. occupancy data from weight-based occupancy sensors, or arrival or departure events from motion detection sensors) from the parking sensors. The sensors reader 78 may be wired to the sensors S, or may be in wireless communication via a local WiFi or other wireless data communication network. In the interest of data collection efficiency, the sensors reader 78 is typically disposed on the premises of, or closely proximate to, the parking facility 60. Nonetheless, depending upon the communication pathway and the processing capacity of the sensors reader 78, there may be time delays and potentially errors introduced by this data gathering process.

The parking event data acquired by the parking sensors S and the sensors reader 78 are communicated to a parking guidance forecasting server 80. Depending upon the task to be performed, this server 80 may be located locally at the parking facility 60, or may be remotely located. For example, if the only task to be performed by the parking guidance forecasting server 80 is to operate the "Lot full" sign 76, then local placement may be appropriate (indeed, in such an embodiment it may be practical to integrate the sensors reader with the forecasting server as a single component). On the other hand, if the parking guidance forecasting server 80 has a wider scope of application, such as generating parking occupancy data for analysis at a city parking department, providing parking recommendations for motorists, or so forth, then a remote placement may be more appropriate, as the parking guidance forecasting server 80 in such embodiments is likely to provide forecasting for a number of different parking facilities. For example, to provide parking recommendations the parking guidance forecasting server 80 beneficially forecasts parking occupancies for a number of different parking facilities (including the illustrative parking facility 60) in order to recommend the parking facility with lowest forecast occupancy.

The parking guidance forecasting server 80 is configured to provide a forecast of the parking occupancy of the parking facility 60 at some time in the future, typically on the order of one to twenty minutes inclusive in the future, and in some embodiments 2-10 minutes into the future. Such a time frame is useful, for example, in operating the "Lot full" sign 76, since it is desirable to predict when the lot will be full a few minutes into the future so as to turn the "Lot full" 76 on a few minutes before the parking facility 60 is actually full in order to provide the last vehicles entering the facility time to park. Likewise, such a time frame is useful in the case of providing a parking recommendation to a vehicle navigation device since the request for a parking recommendation is preferably made a few minutes before the vehicle is actually at the parking facility (e.g. perhaps issued as the vehicle is approaching the freeway exit ramp into downtown). Put more precisely, in some illustrative embodiments it is desired that at a time t the parking guidance forecasting server 80 determines a parking occupancy forecast for a time t+s where s denotes a time horizon 82. In some embodiments, s is in the range [1 min, 20 min] inclusive, though a larger or smaller value of s is also contemplated depending upon the application.

The parking guidance forecasting server 80 is suitably implemented as a computer (e.g. a server computer) or other electronic processing device including a microprocessor or other electronic processor, and a non-transitory storage medium which stores instructions readable and executable by the computer or other electronic processor to perform an embodiment of the disclosed parking guidance forecasting method. The non-transitory storage medium may, for example, comprise one or more of: an internal hard disk drive of a computer, an external hard drive or a network-accessible hard drive or RAID or other magnetic storage medium; or may be a solid state drive (SSD) of a computer or some other electronic storage medium; or may be an optical disk or other optical storage medium; or may be some combination of the foregoing; or so forth. The parking guidance forecasting server 80 is in communication with the sensors reader 78 to receive parking event data acquired by the parking sensors S of the parking facility 60. For example, the communication pathway from the sensors reader 78 to the parking guidance forecasting server 80 may include one or more of a wired and/or wireless local area network (LAN), the Internet, various combinations thereof, or so forth.

The parking guidance forecasting server 80 is also in operative communication with an electronic device (other than the parking guidance forecasting server 80 itself) that receives parking guidance information from the parking guidance forecasting server 80. By way of illustration, the parking guidance forecasting server 80 may be in wired or wireless communication with the "Lot full" sign 76 to turn that sign on or off based on whether the forecast parking occupancy indicates the parking facility 60 is likely to be full at the future time t+s. In another example, the parking guidance forecasting server 80 may be in wireless communication with a vehicle navigation device 84 of a vehicle 86 in order to provide a parking recommendation to the navigation device 84. The navigation device 84 may, for example, be a cellular telephone ("cellphone"), tablet computer, dashboard-mounted navigation unit of the vehicle 86, or so forth. The navigation device 84 is in wireless communication with the parking guidance forecasting server 80 via a suitable communication link such as a cellular telephone (e.g. 4G) link. The navigation device 84 includes locating hardware for locating the navigation device 84 (and, by extension, the vehicle 86) in the city or other locale. In the illustrative embodiment, the locating hardware comprises a Global Positioning System (GPS) receiver 88; additionally or alternatively, the locating hardware may comprise a WiFi radio accessing a WiFi location service, a 4G or other cellular radio leveraging a cellular location service based on cell tower signal strengths, and/or so forth. The navigation device 84 includes an electronic processor (e.g. microprocessor or microcontroller) that runs a navigation program ("app") 90 that reads the GPS receiver 88 or other locating hardware to determine a current location of the navigation device 84 (and hence of the vehicle 86). Typically, the navigator app 90 accesses a regional map of the city or other locale either stored in flash memory, a solid state drive (SSD), or other local storage of the navigation device 84 or downloaded via the cellular connection, and displays the relevant portion of the map with the current GPS location indicated, possibly also along with a recommended route or other relevant navigation information.

The navigator app 90 also performs a parking recommendation query process 92 that queries the parking guidance forecasting server 80 to obtain a parking recommendation. This query may be variously triggered, e.g. by a verbal command picked up by a microphone of the navigation device 84, or automatically triggered when the GPS location comes within a threshold distance to (or estimated time of arrival at) a destination. The query may be transmitted by 4G or other cellular link, and preferably includes transmission of the current GPS location so that the server 80 can determine one or more nearby parking facilities (which may or may not include or consist of the illustrative parking facility 60) with a forecast parking occupancy at the future time t+s that is low enough that the vehicle is deemed likely to find an open (i.e. available) parking space. The server 80 then transmits parking guidance suitably comprising an identification of the one or more recommended parking facilities back to the navigation device 84, again suitably via the 4G or other cellular connection, and the navigation app 90 provides these recommendations to the driver (e.g. by plotting them on the displayed map, and/or adjusting the navigation route to terminate at a selected one of the recommended parking facilities, and/or so forth).

In general, the parking guidance forecasting server 80 forecasts the parking occupancy of the parking facility 80 at the future time t+s as follows. Based on the current parking event data received from the sensors S and sensors reader 78, a current occupancy state (denoted herein without loss of generality as current state i) is constructed for the parking facility at the time t. The current occupancy state i estimates the fraction of occupied parking spaces of the parking facility 60 at time t. Occupancy state probabilities are computed for the parking facility 60 at future time t+s using a continuous-time Markov chain model with a generator matrix $Q(\theta)$ 96 (where $\theta$ is a parameter vector learned on training data) modified by multiplying the time s input to the model by a random variable $\xi$ 98 and scaling the occupancy state probabilities by an expectation of the random variable $\xi$ 98. Parking guidance information is then generated based at least on the computed occupancy state probabilities, e.g. if the parking states run from 0-n where n is the number of parking spaces (so the state n means the lot is completely full while the state 0 means the lot is completely empty) then the parking guidance may be computed as the most probable state and, if this most probable state is within some threshold of n then the parking facility 60 is deemed to be likely to be full at time t+s.

In the following, embodiments of the disclosed forecasting approach are described, both generally and with specific application to the illustrative parking occupancy forecasting task.

The general forecasting task can be formulated as follows. We suppose a system which has state X(t) at time t where X(t) is drawn from a state space of size n. If the state at time t is X(t)=i then the state at time t+s is X(t+s)=j with probability $p_{ij}(s)$. In the classic continuous-time Markov chain model for such a system, one can write $p_{ij}(s)=\exp m(Qs)$ for some matrix $Q\in\mathbb{R}^{n\times n}$ called the generator matrix, where $\exp m(\cdot)$ denotes the matrix exponential. One problem with such a model is that the number of transitions of real-world systems over a time interval [t, t+s) is usually more variable than such a continuous-time Markov model would predict. If this problem is not addressed, forecasts will be more precise than is justifiable and as a consequence, resource allocation and guidance will be suboptimal as the uncertainty involved will be underestimated.

A simple formulation of the forecasting task applied to parking occupancy forecasting is as follows. One has n sensors S in n parking spaces (where as a non-limiting example, n=52 for the parking facility 60 shown in illustrative FIG. 1). These sensors S accurately observe the state $X(t)\in\mathbb{Z}_{n+1}$ (so there are n+1 states) which represents the number of vehicles parked at time t. To forecast whether a parking space will be available at future time t+s, the parking guidance system computes the probability $\mathbb{P}(X(t+s)<n|X(t)=x)$ that a space is available at time t+s which is when a driver is predicted to arrive.

In a more realistic parking guidance setting, one has m<n sensors S in n parking spaces which sense parking events consisting of arrivals and departures. For instance, in illustrative FIG. 1 there are 26 sensors S but there are 52 parking spaces. Such a reduced number of sensors can be used to optimise a trade-off between the value of sensor data and the cost of sensing. Furthermore, in the illustrative formulation which follows, the occupancy of the parking spaces is not directly sensed. Rather, there is a variable delay between each event and its reception by the forecasting system. This delay typically includes: (i) the time for the sensors to detect signals corresponding to each event and to send them to the network; (ii) the time for the network to transmit these signals; (iii) the time for any remote signal processing; and (iv) the time for other networks to transmit the processed signals and store them in buffers before they are used by the forecasting system. In some analyses of some existing parking sensor systems, it has been found that roughly 80% of delays are between 40 seconds and 120 seconds, but the top 10% of delays have a heavy-tailed distribution, frequently involving delays of over 1 hour. Also the appropriate horizon s 82 over which we should forecast is uncertain, since the exact time at which a driver using a parking navigation system will arrive is unknown due for instance to variations in traffic flow.

Additionally, the sensors S do not always identify arrivals or departures, but rather sometimes send signals corresponding to "unknown" events as the signals were too ambiguous to classify as arrivals, departures or background noise. Furthermore, sensors sometimes stop working and fail to send any signals for a long period. For instance if there are usually 4 events per day at a sensor and we have waited over a day since the last event, then we may make an inference that the sensor has stopped working. Finally, sensors may sometimes detect that a parking space is vacant when it is in fact occupied and vice versa. In analyses of some existing parking sensor systems, the false-positive rate was around 5% and the false-negative rate was around 10%. This can make it hard to tell if a block face (or other parking facility) is full. For instance, a full block face with n=7 stalls would only be detected as full with probability $0.9^7 \approx 0.478$.

Some illustrative examples of disclosed forecasting approaches employing a continuous-time Markov chain model with generator matrix Q(θ) 96 (where θ is a parameter vector learned on training data) modified by multiplying the time s input to the model by random variable ξ 98 and scaling the occupancy state probabilities by the expectation of the random variable ξ 98 are next described. Suppose $X(t) \in [n]$ is a continuous-time Markov chain with generator $Q \in \mathbb{R}^{n \times n}$. Then $\mathbb{P}(X(t+s)=j|X(t)=i)=[\mathrm{expm}(Qs)]_{ij}$ where for $A \in \mathbb{R}^{n \times n}$ the matrix exponential is $$\mathrm{expm}(A) := \sum_{k=0}^{\infty} \frac{A^k}{k!}.$$

This Markov chain model is modified as disclosed herein by modeling a variable delay, an uncertain horizon or a variable number of events over the horizon. This is done by replacing time s by a random variable ξs and setting:

$$\mathbb{P}_{X(t+s)=j|X(t)=i} = \mathbb{E}(\xi) \cdot \mathrm{expm}(Q\xi s) \tag{1}$$

where $\mathbb{E}(\xi)$ denotes the expectation of the random variable ξ. This term mainly contributes to the variance, and adds an additional degree of freedom to decouple variance and average.

In one illustrative embodiment, the random variable ξ 98 is a unit-mean gamma-distributed random variable with variance v, that is to say:

$$\xi:\mathrm{gamma}(\mathrm{mean}=1,\mathrm{variance}=v) \tag{2}$$

Said another way, the probability density function of the random variable ξ is the aforementioned unit-mean gamma-distribution. For this formulation of the random variable ξ, Equation (1) has the following closed form in terms of the matrix power function:

$$\mathbb{E}(\xi) \cdot \mathrm{expm}(Q\xi s) = (I - vsQ)^{-1/v} \tag{3}$$

This can be derived by considering the moment-generating function of gamma-distributed random variables.

In another illustrative embodiment, rather than assuming a single gamma random variable, a more general model is a mixture of $n_m$ gamma random variables with unit mean so that:

$$\xi|k:\mathrm{gamma}(\mathrm{mean}=\mu_k,\mathrm{variance}=v_k) \tag{4}$$

where:

$$k: \mathrm{multinomial}(w_1, w_2, \ldots, w_{n_m}) \tag{4a}$$

under the constraint that:

$$1 = \sum_{i=1}^{n_m} w_i = \sum_{i=1}^{n_m} w_i \mu_i,\ w_i \geq 0,\ \mu_k \geq 0,\ v_k \geq 0 \tag{4b}$$

For this formulation of the random variable ξ, Equation (1) has the following closed form in terms of the matrix power function:

$$\mathbb{E}(\xi) \cdot \mathrm{expm}(Q\xi s) = \sum_{k=1}^{n_m} w_k (I - v_k \mu_k s Q)^{-\frac{1}{v_k}} \tag{5}$$

This representation adds substantial flexibility to the model. For instance, in parking data we see a heavy-tailed delay (recall that in the mentioned parking sensors system analysis roughly 80% of delays were between 40 seconds and 120 seconds, but the top 10% of delays had a heavy-tailed distribution frequently involving delays of over 1 hour). This heavy-tailed distribution can be captured as a mixture of a low variance and a high variance gamma random variables.

In the following illustrative examples, the random variable ξ 98 is assumed to have a probability distribution function which is a single gamma distribution, that is, the example of Equations (2) and (3) above.

Figure 2:
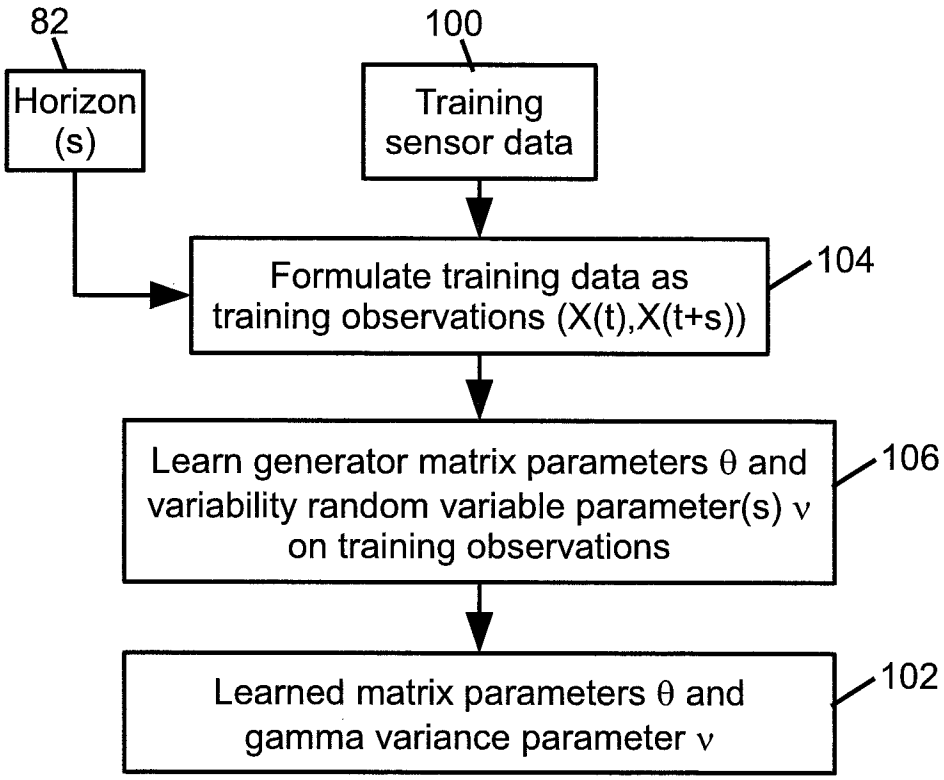
FIG. 2 diagrammatically illustrates a training process performed by the parking guidance forecasting server to learn parameters of a parking occupancy forecasting process.

With reference to FIG. 2, sensor training data 100 is used to train the model parameters 102. In the illustrative embodiment employing the random variable ξ having a single gamma distribution as its probability density function, the trained model parameters include the matrix parameters θ and the gamma variance parameter v. In other embodiments employing a different random variable, the appropriate parameters of the probability density function of the employed random variable are suitably trained; e.g., if the mixture of of $n_m$ gamma random variables with unit mean of Equation (4) is used then the training is performed to train the means $\mu_k$, variances $v_k$, and weights $w_k$ for $k=1, \ldots, n_m$ subject to the constraint of Equation (4b). The training process of FIG. 2 may, for example, be performed by the forecasting server 80 (see FIG. 1). To perform the training, the training sensor data 100 are converted in an operation 104 to training observations (X(t),X(t+s)). This is straightforward since the X(t) and X(t+s) are simply the number of occupied parking spaces measured by the sensors S at times t and t+s, respectively, in the training sensor data 100. In an operation 106, these observations (X(t),X(t+s)) are then used to train the model parameters 102. Some non-limiting illustrative examples of ways to perform the training operation 106 are described next.

Given observations of $((X(t_k)=i_k, X(t_k+S)=j_k): k=1,2, \ldots, n_o)$ and a parameterized model Q(θ) for the generator matrix 96 for parameter vector $\theta \in \mathbb{R}^{n_p}$ one might learn parameters (θ; v) using any of a wide range of conventional methods such as maximum likelihood and maximum a posteriori probability (MAP) estimation as well as generalised expectation maximisation (GEM) methods for mixture models. For instance, MAP estimation would start with a regularisation function R(θ, v) (such as a log prior) and proceed by applying any gradient or Hessian-based optimization method to:

$$\text{maximize } M(\theta, v) := \left\{ \sum_{k=1}^{n_0} \log\left( \left[ (I - vsQ(\theta))^{-\frac{1}{v}} \right]_{i_k j_k} \right) \right\} + R(\theta, v) \text{ with respect to } \theta \text{ and } v \tag{6}$$

In order to estimate parameters θ, v as per Equation (6), the efficient and stable computation of the derivatives of the matrix power function is suitably done as follows. In general the derivative of a matrix functions $f: \mathbb{R}^{n \times n} \rightarrow \mathbb{R}^{n \times n}$ at $A \in \mathbb{R}^{n \times n}$ in direction $E \in \mathbb{R}^{n \times n}$ is known as the Fréchet derivative $L_f(A,E)$. This is a function such that:

$$f(A+E) - f(A) - L_f(A,E) = o(\|E\|) \tag{7}$$

for all $A,E \in \mathbb{R}^{n \times n}$ and if $L_f(A,E)$ exists then it is unique. Thus we may write:

$$L_f(A, E) = \left(\frac{\partial f(A + tE)}{\partial t}\right)_{t=0} \tag{8}$$

For the subject model, it may be noted that:

$$(I-vQ)^{-1/v} = \exp m(-(1/v)\log m(I-vQ)) \tag{9}$$

Thus a stable and efficient computation of the derivatives proceeds by applying two functions expm_frechet_pade and log m_frechet_pade. See Al-Mohy et al., "Computing the Frechet derivative of the matrix exponential, with an application to condition number estimation", SIAM Journal on Matrix Analysis and Applications, 30 (4): 1639-1657 (2009); Al-Mohy et al., "Computing the Fréchet derivative of the matrix logarithm and estimating the condition number", SIAM Journal on Scientific Computing 35 (4): C394-C410 (2013).

Having discussed the general formulation, application to the task of parking occupancy forecasting is next described. Again, the single gamma probability density function formulation of the random variable $\xi$ as per Equations (2) and (3) is again used. Let $Z(t) \in \mathbb{Z}_{n+1}$ be the occupancy of a set of n stalls at time t. We wish to predict $Z(t_b)|Z(t_a)$ for current time $t_a$ and prediction time $t_b > t_a$. Let the midpoint of this interval be $t_m := (t_a + t_b)/2$.

In a simple model of parking, over interval $[t_a, t_b]$ vehicles attempt arrive at rate $\lambda(t_m) \in \mathbb{R}_+$ and each vehicle departs at rate $\mu(t_m) \in \mathbb{R}_+$. A more general model might allow for time-varying rates over $[t_a, t_b]$, but then we would not typically have a matrix-exponential solution to the basic continuous-time Markov chain and as we are aiming at short-term prediction, it seems reasonble to assume that the rates are constant over a short time interval. Let us fix a particular $t_m$ and write $\lambda = \lambda(t_m)$ and $\mu = \mu(t_m)$.

The generator matrix $Q \in \mathbb{R}^{(n+1)\times(n+1)}$ (where element $Q_{ij}$ corresponds to $i = Z(t^+)+1$ and $j = Z(t)+1$ and $t^+$ is the time just after t) for this continuous-time Markov chain is given by $Q := \Delta A + \mu B$. In terms of the Kronecker delta we have $[A]_{ij} := \delta_{i-1,j} - \delta_{i,j}$ and $[B]_{ij} := i(\delta_{i,j-1} - \delta_{i,j})$. For instance, for n=4 we have:

$$A := \begin{bmatrix} -1 & 0 & 0 & 0 & 0 \\ 1 & -1 & 0 & 0 & 0 \\ 0 & 1 & -1 & 0 & 0 \\ 0 & 0 & 1 & -1 & 0 \\ 0 & 0 & 0 & 1 & 0 \end{bmatrix} \tag{10a}$$

and $$B := \begin{bmatrix} 0 & 1 & 0 & 0 & 0 \\ 0 & -1 & 2 & 0 & 0 \\ 0 & 1 & -2 & 3 & 0 \\ 0 & 0 & 0 & -3 & 4 \\ 0 & 0 & 0 & 0 & -4 \end{bmatrix} \tag{10b}$$

Thus applying Equation (3) yields:

$$\mathbb{P}(Z(t_b)=i|Z(t_a)=j) = [(I-v(t_b-t_a)(\lambda A+\mu B))^{-1/v}]_{ij} \tag{11}$$

Figure 3:
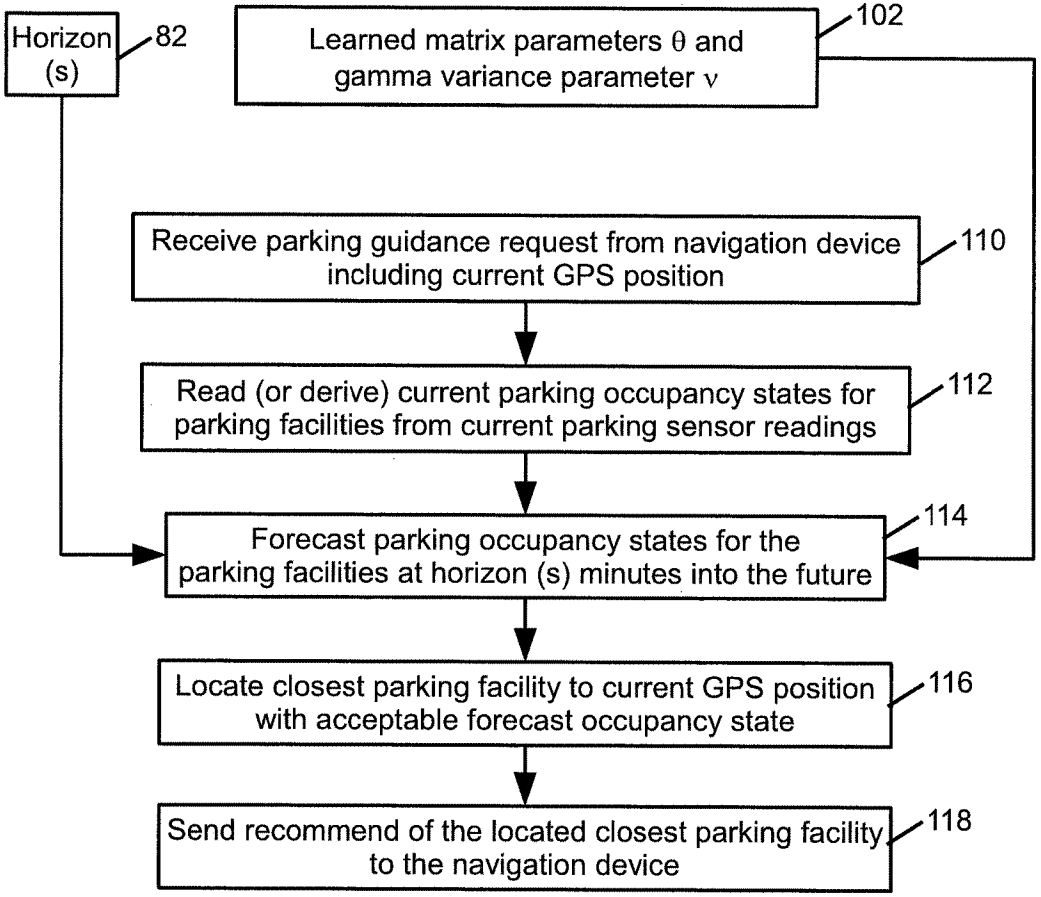
FIG. 3 diagrammatically illustrates a parking facility recommendation process performed by the parking guidance forecasting server to provide a parking facility recommendation to a Global Positioning System (GPS) enabled navigation device.

With reference to FIG. 3, a parking facility recommendation process is described, which is suitably performed by the parking guidance forecasting server 80 (see FIG. 1) to provide a parking facility recommendation to the GPS enabled navigation device 84. In an operation 110, a parking guidance request is received at the server 80 from the navigation device 84, for example via a 4G or other cellular link. This request preferably includes the current GPS position of the navigation device 84 (and hence of the vehicle 86) so as to enable the server 80 to recommend a nearby (or even closest) parking facility forecast to have available parking spaces. In an operation 112, the current parking occupancy states at current time t are read from the sensors of parking facilities in the vicinity. This may entail deriving the current occupancy states from the sensor data in the case of motion sensors that detect arrivals/departures. For recommending a parking facility, it will be appreciated that the server 80 performs parking occupancy forecasting for the illustrative parking facility 60 (see FIG. 1) but also for other parking facilities in the vicinity in order to recommend the best parking option. In an operation 114 the parking occupancy states at time t+s are forecast, e.g. using Equation (11) to estimate the probabilities of the various possible parking states and selecting the most probable state (or some aggregation of the probabilities, e.g. the average of the three most probable states or so forth). This again is done for each parking facility in the vicinity. In an operation 116 the closest parking facility to current GPS position of the navigation device 84 (and hence vehicle 86) with an acceptable forecast occupancy state is located. This entails identifying all parking facilities with an acceptable forecast parking occupancy (e.g. forecast to have available parking spaces at time t+s with some minimum probability) and then referencing an electronic map using conventional GPS navigation processing to assess which parking facility (or facilities) with acceptable parking forecast are closest to the GPS position. In an operation 118, the parking facility recommendation (or, optionally, two or more such facility recommendations to provide the driver with options) is sent to the navigation device 84, e.g. via the 4G or other cellular link. At the navigation device 84, this information is presented to the driver in any suitable manner, e.g. by updating the navigation destination to the recommended parking facility, and/or by displaying a marker at the recommended parking facility (or facilities, if two or more facility recommendations are provided), and/or so forth.

Figure 4:
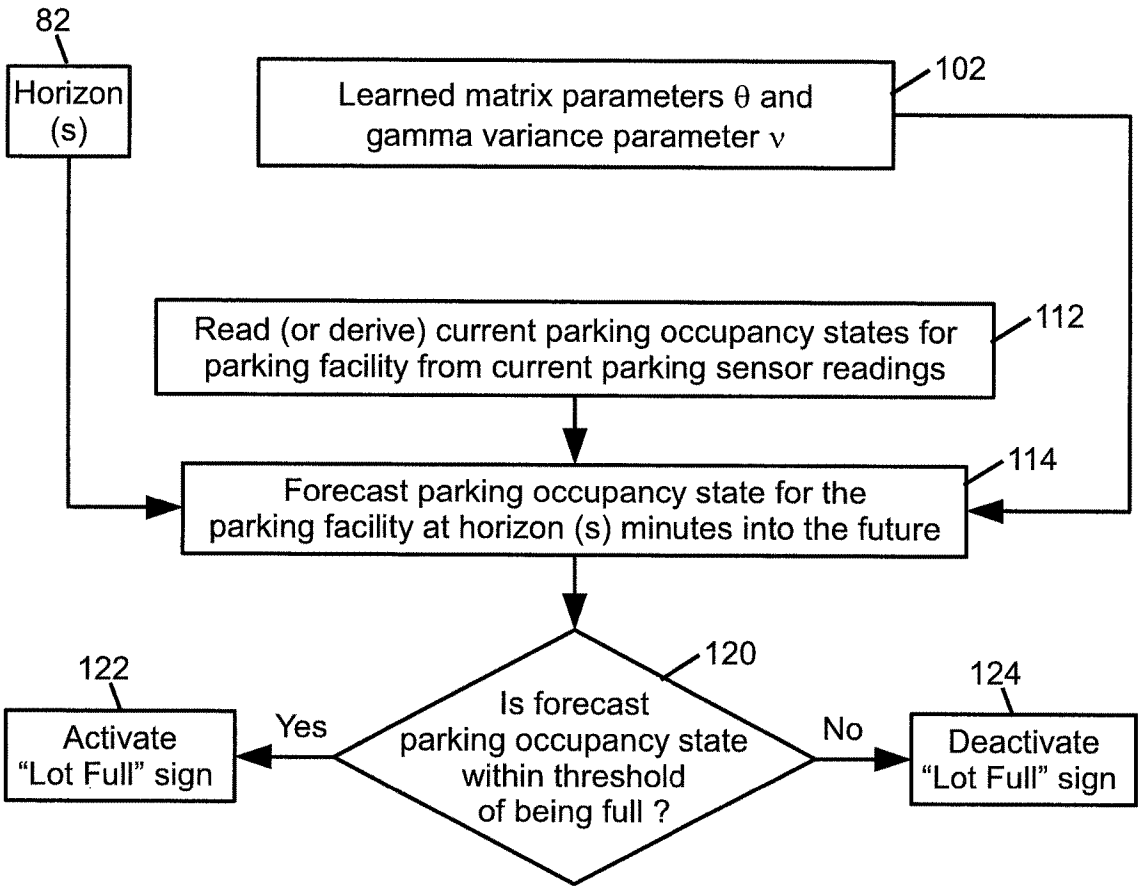
FIG. 4 diagrammatic illustrates a process performed by the parking guidance forecasting server to activate or deactivate a "Lot full" sign of a parking facility based on parking occupancy forecast by the parking guidance forecasting server for the parking facility.

With reference to FIG. 4, a process is described which is suitably performed by the parking guidance forecasting server 80 to activate or deactivate the "Lot full" sign 76 of the parking facility 60 based on parking occupancy forecast by the parking guidance forecasting server 80 for the parking facility 60. The sensor data receipt operation 112 is performed as described with reference to FIG. 3 in order to estimate the current parking occupancy state of the parking facility 60 at current time t, and the operation 114 is performed as described with reference to FIG. 3 to forecast the parking occupancy state of the parking facility 60 at future time t+s. Unlike the parking facility recommendation task of FIG. 3, for the "lot full" sign control task of FIG. 4 the operations 112, 114 are suitably performed only for the parking facility 60 with which the "lot full" sign 76 is associated. In a decision operation 120, it is determined whether the parking occupancy state forecast for future time t+s is within a threshold of being full. In some embodiments, the operation 120 is satisfied only if the forecast parking occupancy is exactly full, that is, if there are n parking spaces and the forecast parking occupancy is exactly equal to n. In other embodiments, the operation 120 is satisfied if the forecast parking occupancy is close to full, e.g. if there are n parking spaces and the forecast parking occupancy is greater than or equal to a threshold (n−Δ) where Δ is some number of parking spaces providing a cushion. (For example, in the case of the parking facility 60 of FIG. 1, n=52 and Δ=3 may be a suitable cushion, so that the operation 120 concludes the parking facility 60 will likely be full at future time t+s if the forecast occupancy is greater than or equal to (n−Δ)=(52−3)=49 occupied parking spaces. Such a cushion may be useful to accommodate a finite sensor error rate or other measurement uncertainties. (A similar "cushion" approach may be used to assess when a parking facility will have available spaces at time t+s in the operation 116 of FIG. 3). If the operation 120 concludes the parking facility 60 will likely be full at the future time t+s then in an operation 122 the "lot full" sign 76 is activated (encompassing keeping it activated if already activated); whereas, if the operation 120 concludes the parking facility 60 will likely not be full at the future time t+s then in an operation 124 the "lot full" sign 76 is deactivated (encompassing keeping it deactivated if already deactivated).

The illustrative embodiments are directed to forecasting parking occupancy of a parking facility. More generally, the disclosed forecasting entails computing probabilities $p_{ij}$ of the state of a system at a future time t+s, where $p_{ij}$ is the probability that the system is in state j at the future time t+s and $p_{ij}$ is computed to have a value given by $p_{ij}=\mathbb{E}(\xi)\cdot[\exp m(Q\xi s)]i_j$ where expm( . . . ) denotes the matrix exponential, Q is a generator matrix, is a random variable having a non-negative probability density function, and $[\exp m(Q\xi s)]_{ij}$ denotes element (i,j) of the matrix quantity $\mathbb{E}(\xi)\cdot\exp m(Q\xi s)$. Such forecasting can be usefully employed in diverse applications in which it may be anticipated that the transitions over the time interval [t, t+s) may exhibit greater variability than that predicted by a conventional continuous-time Markov model. For example, the disclosed forecasting approaches may find application in other forecasting tasks such as forecasting the number of queued print jobs at a print shop, or forecasting the waiting list for an Emergency Medical Department, or so forth.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A parking guidance device comprising:

an electronic processor; and a non-transitory storage medium operatively connected with the electronic processor and storing instructions readable and executable by the electronic processor to perform a parking guidance method including:

receiving, at the electronic processor, parking event data acquired by parking sensors of a parking facility;

constructing a current occupancy state i for the parking facility at a time t from the received parking event data wherein the current occupancy state estimates a fraction of parking spaces of the parking facility occupied at the time t;

computing occupancy state probabilities for the parking facility at a future time t+s using the matrix quantity $\mathbb{E}(\xi)\cdot\exp m(Q\xi s)$ where expm( . . . ) denotes the matrix exponential, Q is a generator matrix, and ξ is a random variable;

generating parking guidance information based at least on the computed occupancy state probabilities; and transmitting the parking guidance information to an electronic device other than the electronic processor.

2. The parking guidance device of claim 1 wherein the computing of the occupancy state probabilities includes computing the occupancy state probability $p_{ij}$ of an occupancy state j at the future time t+s as:

$$p_{ij}=\mathbb{E}(\xi)\cdot[\exp m(Q\xi s)]_{ij}$$

where $[\exp m(Q\xi s)]_{ij}$ denotes element (i,j) of the matrix quantity $\mathbb{E}(\xi)\cdot\exp m(Q\xi s)$.

3. The parking guidance device of claim 1 wherein the computing of the occupancy state probabilities includes:

computing the matrix quantity $\mathbb{E}(\xi)\cdot\exp m(Q\xi s)$ as:

$$\mathbb{E}(\xi)\cdot\exp m(Q\xi s)=(I-vsQ)^{-1/v}$$

where I is an identity matrix, and the probability density function of the random variable ξ is a gamma distribution with unity mean and variance v.

4. The parking guidance device of claim 1 wherein the computing of the occupancy state probabilities includes:

computing the matrix quantity $\mathbb{E}(\xi)\cdot\exp m(Q\xi s)$ as:

$$\mathbb{E}(\xi)\cdot\exp m(Q\xi s)=\sum_{k=1}^{n_m} w_k(I-v_k\mu_k sQ)^{-\frac{1}{v_k}}$$

where the probability density function of the random variable ξ is a mixture of $n_m$ gamma distributions where the $k^{th}$ gamma distribution has mean $\mu_k$ and variance $v_k$ and has weight $w_k$ in the mixture of $n_m$ gamma distributions, and wherein the weights satisfy the normalization constraint:

$$\sum_{n=1}^{n_m} w_k=1.$$

5. The parking guidance device of claim 1 wherein:

the parking guidance information comprises a parking recommendation generated based at least on the computed occupancy state probabilities for the parking facility at the future time t+s; and the transmitting comprises transmitting the parking recommendation to a Global Positioning System (GPS) enabled navigation device.

6. The parking guidance device of claim 5 wherein the parking guidance method further includes:

receiving, at the electronic processor, a location of the GPS enabled navigation device wirelessly transmitted by the GPS enabled navigation device;

wherein the generating of the parking recommendation is further based on a distance between the GPS enabled navigation device and the parking facility computed from the received location of the GPS enabled navigation device.

7. The parking guidance device of claim 1 further comprising:

an electronic sign having a facility closed state indicating the parking facility is full and a facility open state indicating the parking facility is open;

wherein the parking guidance information comprises a control signal having one of:

(i) a value effective to switch the electronic sign to the facility closed state if the computed occupancy state probabilities indicate the parking facility will be full at the future time t+s, or (i) a value effective to switch the electronic sign to the facility open state if the computed occupancy state probabilities indicate the parking facility will not be full at the future time t+s.

8. The parking guidance device of claim 1 wherein s has a value between one minute and twenty minutes inclusive.

9. The parking guidance device of claim 1 wherein the parking event data received at the electronic processor consist of vehicle arrival and departure events detected by the parking sensors of the parking facility.

10. The parking guidance device of claim 1 further comprising:

said parking sensors of the parking facility;

wherein the parking sensors are arranged to monitor one-half or fewer of the parking spaces of the parking facility whereby at least one-half of the parking spaces of the parking facility are not monitored by the parking sensors.

11. A non-transitory storage medium storing instructions readable and executable by an electronic processor to perform a forecasting method comprising:

receiving, at the electronic processor, data characterizing a system;

constructing a current state i of the system at a time t from the received data;

computing probabilities $p_{ij}$ of the state of the system at a future time t+s where $p_{ij}$ is the probability that the system is in state j at the future time t+s and $p_{ij}$ is computed to have a value given by:

$$p_{ij}=\mathbb{E}(\xi)\cdot[\exp m(Q\xi s)]_{ij}$$

where expm( . . . ) denotes the matrix exponential, Q is a generator matrix, ξ is a random variable having a non-negative probability density function, and $[\exp m(Q\xi s)]_{ij}$ denotes element (i,j) of the matrix quantity $\mathbb{E}(\xi)\cdot\exp m(Q\xi s)$; and generating a forecast state of the system at the future time t+s based on the computed probabilities $p_{ij}$.

12. The non-transitory storage medium of claim 11 wherein the computing of the probabilities $p_{ij}$ includes computing:

$$p_{ij}=\mathbb{E}(\xi)\cdot[(I-vsQ)^{-1}]_{ij}$$

where I is an identity matrix, and the probability density function of the random variable ξ is a gamma distribution with unity mean and variance v.

13. The non-transitory storage medium of claim 11 wherein the computing of the probabilities $p_{ij}$ includes computing:

$$p_{ij}=\mathbb{E}(\xi)\cdot\left[\sum_{k=1}^{n_m} w_k(I-v_k\mu_k sQ)^{-\frac{1}{v_k}}\right]_{ij}$$

where the probability density function of the random variable ξ is a mixture of $n_m$ gamma distributions where the $k^{th}$ gamma distribution has mean $\mu_k$ and variance $v_k$ and has weight $w_k$ in the mixture of $n_m$ gamma distributions, and wherein the weights satisfy the normalization constraint:

$$\sum_{n=1}^{n_m} w_k = 1.$$

14. The non-transitory storage medium of claim 11 wherein the forecasting method further comprises:

controlling a component of the system based on the forecast state of the system at the future time t+s.

15. The non-transitory storage medium of claim 11 wherein:

the system is a parking facility and the state of the parking facility is an occupancy state representing the fraction of occupied parking spaces of the parking facility; and the receiving comprises receiving parking event data acquired by parking sensors of the parking facility.

16. The non-transitory storage medium of claim 15 wherein the forecasting method further comprises:

generating a parking recommendation based at least on the forecast occupancy state of the parking facility at the future time t+s; and transmitting the parking recommendation to a vehicle navigation device.

17. The non-transitory storage medium of claim 16 wherein the forecasting method further includes:

receiving, at the electronic processor, a location of the vehicle navigation device wirelessly transmitted by the vehicle navigation device;

wherein the generating of the parking recommendation is further based on the location of the vehicle navigation device.

18. A parking guidance method comprising:

receiving, at an electronic processor, parking event data acquired by parking sensors of a parking facility;

by the electronic processor reading and executing instructions stored on a non-transitory storage medium, performing operations including:

constructing a current occupancy state i for the parking facility at a time t from the received parking event data wherein the current occupancy state estimates the fraction of occupied parking spaces of the parking facility at the time t;

computing occupancy state probabilities for the parking facility at a future time t+s using a continuous-time Markov chain model modified by multiplying the time s input to the model by a random variable ξ and scaling the occupancy state probabilities by an expectation of the random variable ξ; and generating parking guidance information based at least on the computed occupancy state probabilities; and transmitting the parking guidance information to an electronic device other than the electronic processor.

19. The parking guidance method of claim 18 wherein the random variable ξ has a probability density function comprising a gamma function or a mixture of gamma functions.

20. The parking guidance method of claim 18 wherein receiving comprises:

receiving parking event data acquired by the parking sensors of the parking facility wherein the parking event data does not include any information on at least one-half of the parking spaces of the parking facility.

* * * * *